United States Patent [19]

Dilley

[11] 4,177,842

[45] Dec. 11, 1979

[54] TYING MACHINE

[75] Inventor: Gerald G. Dilley, Portland, Oreg.

[73] Assignee: Peters Equipment Corporation, College Point, N.Y.

[21] Appl. No.: 872,013

[22] Filed: Jan. 25, 1978

[51] Int. Cl.[2] ..... B21F 7/00; B21F 15/04

[52] U.S. Cl. ..... 140/93.6; 140/115; 100/26; 100/31

[58] Field of Search ..... 100/26, 31; 140/93.6, 140/115, 116, 118, 119

[56] References Cited

U.S. PATENT DOCUMENTS

| | | | |
|---|---|---|---|
| 3,318,230 | 5/1967 | Hilton | 100/31 X |
| 3,323,558 | 6/1967 | Collins | 140/93.6 |
| 3,428,096 | 2/1969 | Krylov et al. | 140/93.6 |
| 3,898,924 | 8/1975 | Mead et al. | 100/26 |

*Primary Examiner*—Ervin M. Combs
*Attorney, Agent, or Firm*—Bauer & Amer

[57] ABSTRACT

In a wire twisting machine in which the ends of the tie wire are clamped while these ends are being twisted together to complete the tying of the product, there is proposed improved clamps which, unlike prior art clamps that have clamping strokes of a prescribed dimension, are actuated by pressure air in such manner that the clamping strokes thereof are terminated only when the clamping rods actually abut against their cooperating anvil or wire holding surfaces. Thus, wear or looseness of fit which may subsequently occur in the components of the machine do not adversely affect the clamping service or function of the clamping rods.

4 Claims, 5 Drawing Figures

TYING MACHINE

The present invention relates to product-tying machines, and more particularly to improved and more effective clamps for this type of machinery.

In the patented literature, starting with U.S. Pat No. 3,318,250 and including subsequent U.S. Pat. No. 3,899,924, the development can be traced of a highly utilitarian machine that effectively applies a tie wire about produce products such as asparagus or broccoli stalks, thereby enhancing the condition of these products for retail sale. The tie, which may consist of a wire sandwiched between two strips of adhesively secured together paper, is urged through encircling relation about the product, the opposite ends thereof clamped, and these clamped ends then rotated so as to produce twists therein, which results in the product being effectively tied. While the wire-engaging clamps in known embodiments of this machine, as exemplified by those of the referred to patents, are generally effective, particularly in a new machine, these clamps do not provide entirely satisfactory clamping service and, as the mechanism experiences wear through continued use, these clamps frequently fail to function at all. That is, the clamps fail to hold one or both of the wire ends throughout the entire twisting procedure, with the result that the tie is not firmly engaged about the product.

An object of the present invention is to provide clamps for a tying machine with an improved ability to firmly engage the product, despite even excessive wear and use of the machine, and in this and other ways thereby overcome the foregoing and other shortcomings of the prior art. Specifically, it is an object to provide for closing movement of the clamping rods against their cooperating wire-holding surfaces, with adequate provision for increases in this movement, should it be necessary because of subsequently occurring wear or looseness of fit in the components of the machine.

As already noted, the within improvements are applied to a wire twisting machine of the type wherein a wire length is urged through movement into encircling relation about a product and the opposite ends of said wire length are then clamped, and said clamped wire ends then rotated so as to produce twists in the portions of said wire length adjacent said ends for tying said wire length about said product. More particularly, demonstrating objects and advantages of the present invention are an improved pair of clamps embodied in a cylindrical body journalled for rotation and having a wire-clamping station formed on one end thereof. The clamps, per se, include a pair of circumferentially spaced wire-holding surfaces at the distal end of said body and operatively arranged in clearance positions from said cylindrical body wire-clamping end so as to allow the positioning in said clearances of the wire length ends preparatory to the clamping thereof against said wire-holding surfaces. A pair of clamping rods are respectively disposed in cooperating clamping relation to said wire-holding surfaces, each being operatively arranged for axial movement in said body through a clamping stroke from a starting clearance position into pressing engagement against one of said wire length ends. In this regard, use is made of separate pressure air cylinder-operated means for actuating each clamping rod through its clamping stroke, said separate means each being disposed in pushing contact against the end of said clamping rod remote from the opposite end thereof having said pressing engagement against the wire length ends. As a result, the pressure air exerts a bias which is effective to cause movement in each rod in a direction toward the wire length ends, with the result that each rod moves through its clamping stroke in response to said pressure air until it is firmly against the wire length end that is positioned in front of its wire-holding surface, even though there may have been an increase in the distance that must be actually traversed during said clamping stroke as compared with prior clamping strokes.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 3:
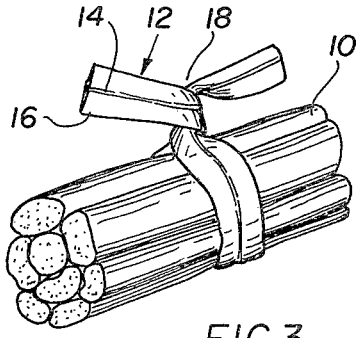
Figure 4:
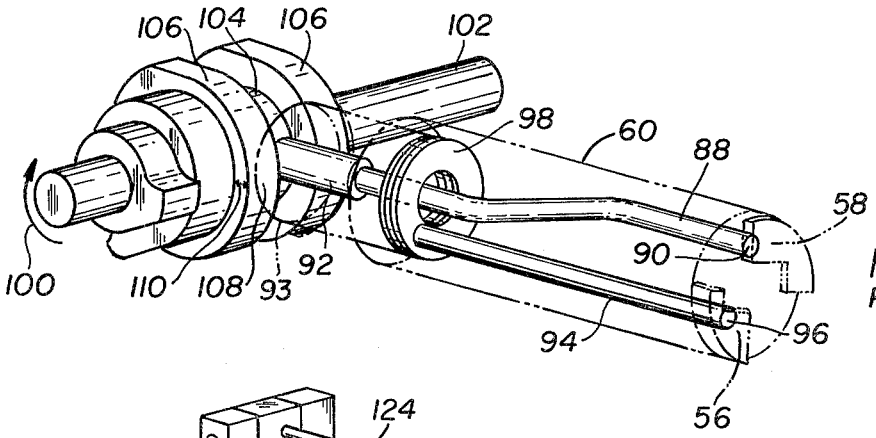
FIG.4 PRIOR ART
Figure 4A:
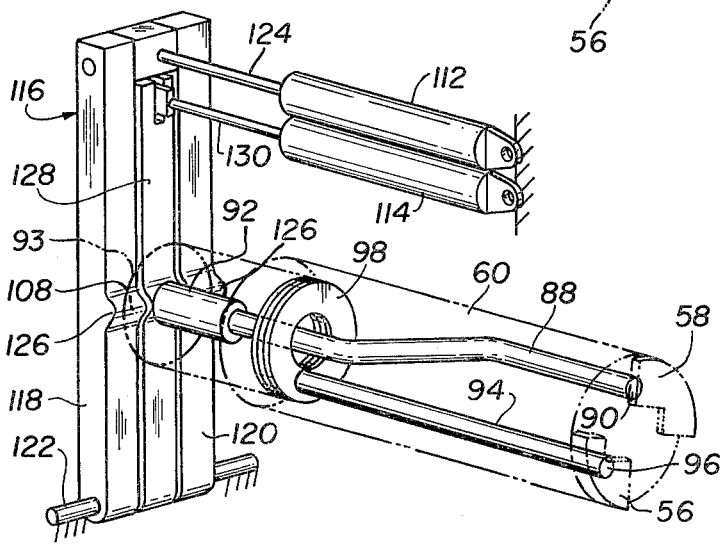

FIG. 3 is a perspective view illustrating how the wire is twisted closed about the product; and FIGS. 4 and 4A are each perspective views which by contrast with each other effectively illustrate the construction and operation of improved clamps for the within device which constitute the present invention. More particularly, FIG. 4 illustrates the construction and mode of operation of the prior art clamps, whereas FIG. 4A illustrates the construction and mode of operation of the within improved clamps.

The machine to which the within improvements are applied, said improvements more particularly being wire-engaging clamps, as will be more specifically discussed in detail subsequently, is a so-called wire twisting machine. The construction and general operation of this machine is already well known, being described in such prior patents as U.S. Pat. No. 3,318,230 issued May 9, 1967 to Frank E. Hilton, and in subsequent U.S. Pat. No. 3,899,924 issued Aug. 12, 1975 to Stanley L. Mead and Gerald G. Dilley, which patents are hereby incorporated by reference in their entireties.

Figure 1:
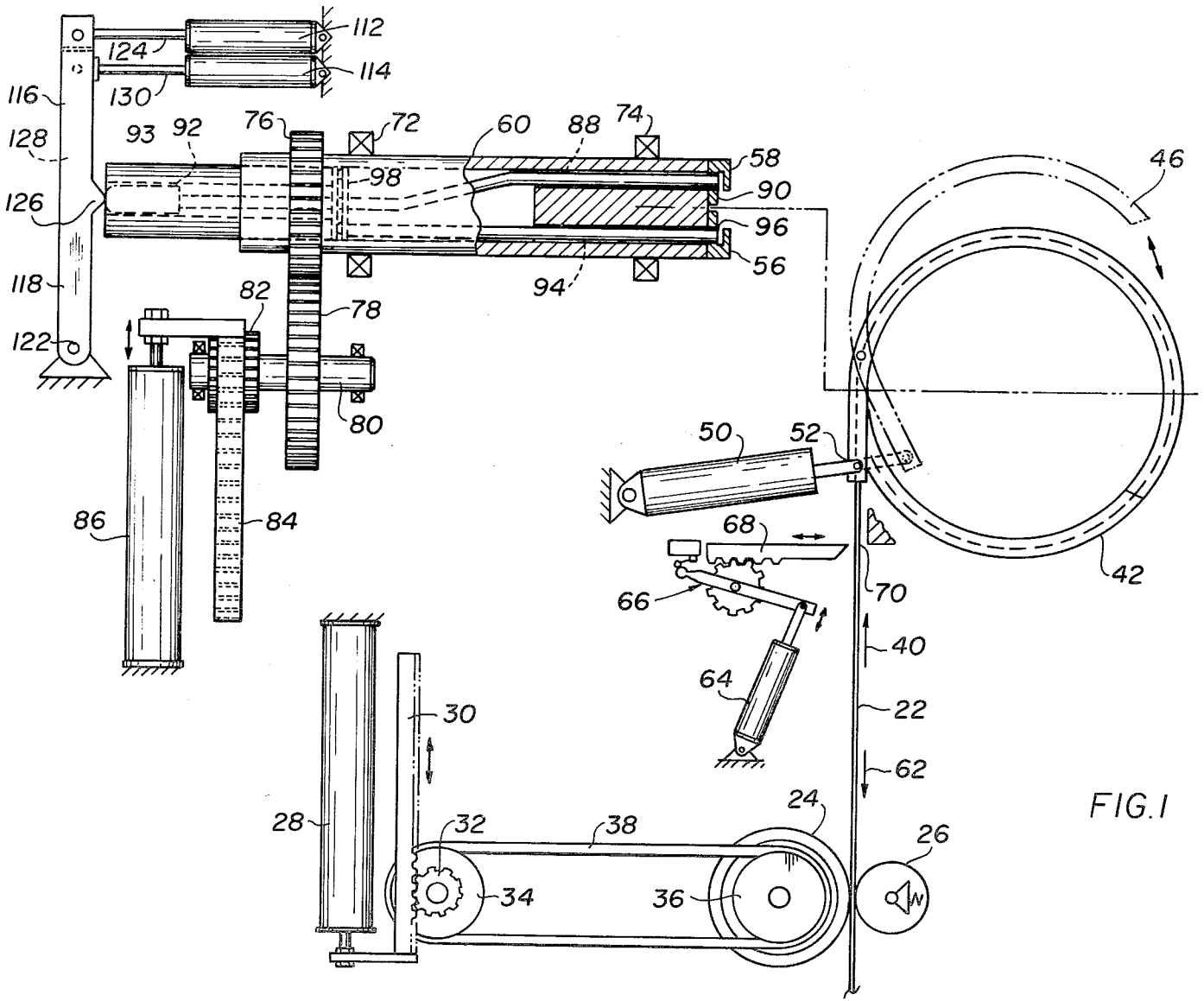
FIG. 1 is a diagrammatic view illustrating the general mode of operation of the wire twisting machine involved herein and of the structure incorporated therein which provides the noteworthy improvements which constitute the present invention.
Figure 2:
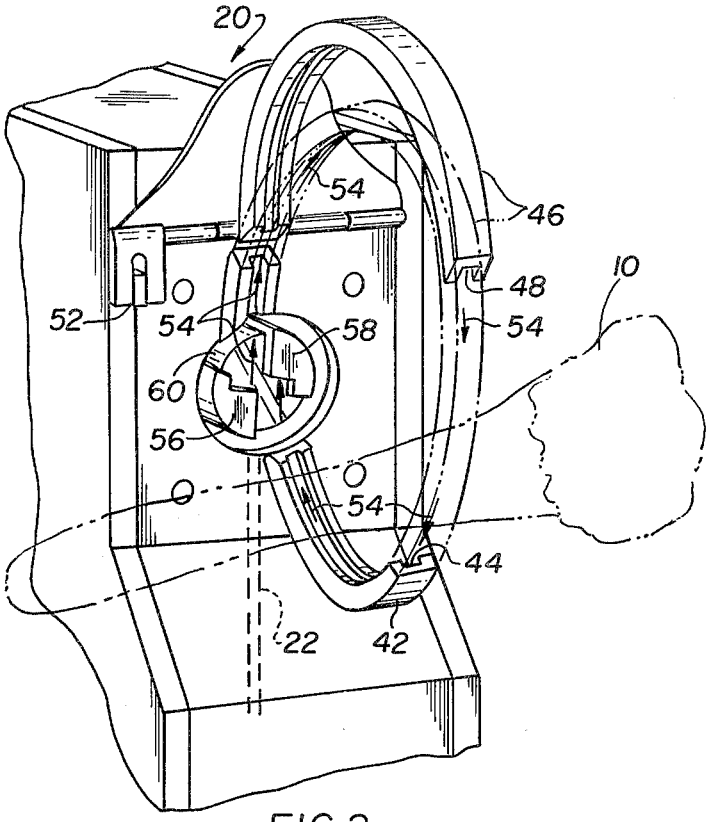
FIG. 2 is a front perspective view which illustrates the manner in which a tying wire is strategically located in encircling relation about a product, said product being illustrated in phantom perspective.

To facilitate an understanding of the within inventive contribution, some comments of a general nature will be helpful in connection with FIGS. 1, 2 and 3. More particularly, illustrated in FIG. 3 is a typical produce product 10 such as asparagus stalkes which are held together, for marketplace convenience, by a tie 12 which consists of a strand of wire 14 sandwiched between two adhesively secured together strips of paper 16. As illustrated, a length of the tie 12, and more particularly the wire 14 thereof, is placed in encircling relation about the product 10 and the wire is twisted, as at 18, to complete the tying thereof about the product 10.

As is already well understood from the patented literature referred to, and as also may be readily surmised from progressive examination of FIGS. 1 and 2, the operation of the wire twisting machine, generally designated 20, which produces the FIG. 3 result, contemplates the movement of an end of a supply length 22 of the wire (see FIG. 1) from a suitable supply reel to a wire twisting station. More particularly, the wire length 22 is engaged between two rollers 24 and 26. Upon actuation of an air cylinder 28, rack 30 is urged through movement causing rotation of pinion 32 in meshing engagement with it. Entrained about pulleys 34 and 36, respectively associated with pinion 32 and previously referred to roller 24, is the endless pulley belt loop 38 which effectively transmits rotation of the pinion 32 to the roller 24. As a consequence, an operative end of the supply length 22 is raised along the feed path 40 to a wire twisting station.

As is perhaps best readily understood from FIG. 2, the wire twisting station essentially consists of a lower half ring 42 having a wire guide groove 44 therein, and a pivotally mounted upper half ring member 46 which is pivotally movable from a raised clearance position through closing movement against the lower ring 42, thereby completing a circular path about the product 10 which is strategically located in the opening bounded by the ring members 42 and 46. Ring member 46, like member 42, also has a guide groove 48 which will be understood to align with groove 44. At this point in the description it is perhaps convenient to note, as illustrated in FIG. 1, that an air cylinder 50 is operatively arranged, as by the operative connection 52, to urge the upper ring member 46 between its open and closed positions with respect to the lower ring member 42.

As is well understood, the encircling relation of the ring members 46, 42 about the product 10 completes a circular guide groove about the product 10 through which the end of the tie 22 is urged through movement, the actual feed path of the tie being denoted by the plural arrows individually and collectively designated 54 in FIG. 2. In this regard, it is especially important to note that in moving through feed path 54, the wire length is threaded in front of two wire clamping surfaces 56 and 58, both of which surfaces are part of a cylindrical cap 57 which is fixedly secured to the distal end of cylindrical body 60. Body 60 and cap 57 thus rotate in unison and result in the twists 18 being imparted to the tie 12. The details of construction and mode of operation of the cylindrical body 60 will be subsequently described in detail.

At this point in the description it is suffice to note that the wire length 22 is urged through movement in front of the wire-clamping surface 56 and then through the guide groove 48 of ring member 46 and guide groove 48 of ring member 42, such that the wire length 22 assumes an encircling position about the product 10. Further movement of the wire length then effectively projects the end thereof in front of the wire-clamping surface 58.

Continuing with the description of the mode of operation of the wire-twisting machine 20, it will be understood that the clamp associated with the surface 58 is actuated so that the wire end in front of this surface (or actually behind the surface as viewed in FIG. 2) is clamped against movement. When this is achieved, and as may be readily appreciated by again referring to FIG. 1, air cylinder 28 is actuated in a reverse direction thus causing reverse direction movement 62 in the wire supply length 22. This, as should be readily appreciated, is effective in drawing the wire length 22 firmly about the product 10. After this is accomplished, the controls of the machine 20 are appropriately programmed to actuate the air cylinder 64 which through a pinion and rack arrangement 66 actuates a cutting instrument 68 through a cutting stroke. Cutter 68 severs the tie 12 at location 70 preparatory to the tie being actually tied about the product 10, as already explained in connection with FIG. 3.

It is at this point in the well understood and known operation of the machine 20 that the second clamp, namely that associated with surface 56 is actuated, to thereby also clamp the tie 12 at a location coincident with surface 56. Thus, tie 12 is held against movement at two locations coincident with the surfaces 56 and 58. Next, the cylindrical body 60, to which as already noted the housing or cap 57 containing the surfaces 56 and 58 is attached for simultaneous rotation, is urged through rotative movement. The result of this rotative movement is to impart the twists 18 in the tie 12, thereby completing the tying of the product 10 together using the tie 12.

An acceptable way of journalling the body 60 for rotation and for urging the same through rotative movement is illustrated diagrammatically in FIG. 1. More particularly, cylindrical body 60 is disposed longitudinally through bearings 72 and 74 and has affixed to it an external ring gear 76. Gear 76 is operatively disposed in meshing engagement with a gear 78 affixed to a shaft 80 which also has affixed to it another gear 82. In meshing engagement with gear 82 is rack 84, which is appropriately urged through opposite directions in response to the operation of an air cylinder 86.

What has been described thus far is well understood by those versed in this technology, and may also be readily understood from the prior patented literature, particularly the patents previously referred to. Accordingly, the aforesaid represents the environment in which the improvements of the present invention are utilized, but is not to be understood to be the crux thereof. Rather, the present invention more particularly resides in improved clamps associated with the previously noted wire-clamping surfaces 56 and 58 and in the mode of operation thereof, all as will now be described in detail with particular reference to FIGS. 4, 4A and FIG. 1.

An understanding of the improved clamps according to the present invention is perhaps facilitated when compared with the prior art clamps and the mode of operation thereof which are replaced by the improved clamps. Accordingly, reference should be made to FIG. 4 illustrating said prior art clamps. Specifically, two clamps are involved, and the description thereof is conveniently made starting with the clamp that is actuated first in time. This clamp is the one which cooperates with the wire-engaging surface 58 and includes a clamping rod 88 which will be understood to be appropriately disposed for axial movement relative to the cylindrical body 60 in a through bore appropriately machined in said cylindrical body. That is, rod 88 will be understood to have a wire engaging surface 90 at one operative end, said end being in facing relation to the clamping surface 58 and, at its opposite end 92, is adapted to be pushed, by means soon to be described, so that rod 88 partakes of a clamping stroke which moves its end 90 from a clearance position into contact against the surface 58, and thus into engaged relation against an end of the tie 12 which previously has been positioned in front of the surface 58.

The other prior art clamp cooperates with the clamping surface 56, and includes a clamping rod 94 also disposed for axial movement relative to the cylindrical body 60 and also having a wire-engaging end 96 in clamping relation to its cooperating clamping surface 56. At its opposite end, rod 94 is affixed to a thrust bearing 98 which will be understood to be in the axial path of movement of a sleeve 13, both bearing 98 and sleeve 93 being disposed for axial movement in a counter bore of the cylindrical body 60. Accordingly, and as understood and described in detail in the patent literature, to actuate clamp 88 a pushing force is applied at end 92 which moves this rod within the cylindrical body 60 bringing the opposite end 90 thereof into clamping relation against the wire in front of surface 58. Next, the sleeve 93 is urged through axial movement such that a pushing force is exerted against thrust bearing 98 and this in turn actuates the rod 94 through its clamping stroke, with the result that the clamping end 96 thereof is effectively moved into wire-engaging relation against the end of the tie 12 which will be understood to be positioned between the end 96 and the wire-holding surface 56.

Still referring to the prior art illustration of FIG. 4, it will be noted that the pushing force applied against the clamping rods 88 and 94 is delivered in response to a pivotal traverse or partial rotation 100 of a control shaft 102. Appropriately mounted on shaft 102 is a cam 104 which cooperates with the rod end 92 to provide a clamping stroke in the rod 88 that has a specific dimension that is related to the dimension of the rise or size of the eccentricity of the cam 104. That is, rod 88 in practice is actuated through a clamping stroke that has a specific dimension, this dimension being the extent that cam 104 extends in its eccentric relation laterally of the rotation axis of the shaft 102. Similarly, rod 94 also has a clamping stroke of a selected dimension. Specifically, located on opposite sides of cam 104 are additional identical cams 106 which will be understood to be in engagement with the peripheral edge 108 of the end of the pushing sleeve 93. Thus, the throw or the distance 110 of the eccentricity of the cams 106 provides a clamping stroke to the rod 94 of a prescribed distance. While the prior art clamps of FIG. 4, as just described, are generally effective, particularly in a new wire-twisting mechanism, these clamps do not provide entirely satisfactory clamping service and, as the mechanism experiences wear through continued use, said prior art clamps frequently fail to function effectively.

An important contribution of the present invention is the recognition that the clamps for a wire-twisting or tying machine of the type herein involved do not provide effective clamping service if the clamping strokes of the rods are limited to specific selected dimensions. Rather, effective clamps require a clamping stroke, which might be of a specific distance initially, but which must be capable of being enlarged to compensate for any wear or looseness of fit which may subsequently occur in the components of the mechanism. Thus, the present invention contemplates an operative arrangement for the rods 88 and 94 that does not prescribe any specific dimension or distance for the clamping strokes of these rods, but rather permits the clamping movement of these rods to whatever extent or distances are necessary to bring the respective ends 90 and 96 thereof firmly against their cooperating wire-holding surfaces 58 and 56.

The improved clamps of the present invention are best illustrated in FIGS. 1 and 4A, to which figures reference should now be made and, in connection with which, the same structural features already described, particularly those in connection with FIG. 4, are designated by the same reference numerals. More particularly, and as should be readily appreciated from FIG. 4A, the improvements hereof reside primarily in the use of pressure air cylinders 112 or 114 to apply the pushing forces to the rods 88 and 94, instead of the previously noted cams and in the manner in which these pressure air forces are applied to the rods 88 and 94. More particularly, mounted in pushing relation adjacent the rear of the cylinder 60 is a U-shaped member 116 whose bifurcated legs 118 and 120 are pivotally mounted at their free ends, as at 122. The upper end of member 116 is connected to the piston rod 124 of cylinder 112. A raised pushing surface 126 on each of the legs 118 and 120 is in contact against the peripheral edge 108 of the rear of sleeve 93, and it should thus be readily appreciated that the air cylinder 112 operating via the member 116 is effective to urge the sleeve 93 through axial movement, thus causing a corresponding clamping stroke in the rod 94.

Situated between the legs 118 and 120 is a third leg or actuating link 128 which also is pivotally mounted relative to the pivot axis 122 and, at its opposite end, is appropriately connected to the piston rod 130 of air cylinder 114. Link 128 is disposed in pushing contact against the rod end 92 and in response to actuation of the air cylinder 114, wherein the piston rod thereof is withdrawn within the cylinder, the rod 88 is urged through axial movement relative to the cylindrical body 60, thus causing the end 90 to close upon any wire end located in front of the surface 58.

From the foregoing it should be readily appreciated that the pressure air cylinders 112 and 114 can be operated independently of each other, and that therefore the rods 88 and 94 are correspondingly actuated through their clamping strokes independently of each other. This therefore enables rod 88 to be actuated first, as is required, and rod 94 subsequent thereto. Moreover, after rods 88 and 94 are both clamped against the wire ends, which it will be understood are positioned in front of the surfaces 58, 56, this clamping action being in response to withdrawal of the piston rods 124, 130 within their respective air cylinders, there is absolutely no difficulty in continuing to exert clamping force via the rods 88 and 94 on said tie wire ends since the pressure medium of the cylinders 112 and 114 is continually exerted against the internal pistons which it will be understood are connected to the ends of the piston rods 124 and 130 which are projected within the cylinders 112 and 114. Thus, the wear which may occur at the end of the cylinder 60 which bears against the axial movement-actuating members 116 and 128 which, incidentally, is wear which can be anticipated as being impossible to prevent and also possibly of a considerable extent since structure at the remote end of member 60 is driven in rotation while in contact with said actuating members, is wear which has no adverse consequences on the clamping service which is provided by the clamping rods 88 and 94. This is in sharp contrast to the prior art clamps of FIG. 4 in which the clamping rods thereof are restricted to a clamping stroke of a prescribed distance which over a period of time of use of the machine may not be adequate to provide firm gripping or clamping engagement of either one or both of the clamping surfaces 90 and 96 against the wire ends positioned in front of their cooperating holding surfaces 58 and 56, respectively. In accordance with the present invention, however, the wire-engaging ends 90 and 96 are always in firm engagement against the wire ends positioned in front of their cooperating surfaces since the pressure air exerted against these rods produces movement that is terminated only when these ends actually abut against their cooperating surfaces 56 and 58.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

I claim:

1. An improved pair of wire-engaging clamps for a wire twisting machine of the type wherein a wire length is urged through movement into encircling relation about a product and the opposite ends of said wire length are then clamped and said clamped wire ends then rotated so as to produce twists in the portions of said wire lengths adjacent said ends for tying said wire lengths about said product, said pair of clamps comprising a cylindrical body journalled for rotation and having a wire-clamping station formed on one end thereof, a pair of circumferentially spaced wire-holding surfaces operatively arranged on said body in clearance positions of a prescribed initial distance from said cylindrical body wire-clamping end so as to allow the positioning in said clearances of said wire length ends preparatory to the clamping thereof against said wire-holding surfaces, a pair of clamping rods respectively disposed in cooperating clamping relation to said wire-holding surfaces each operatively arranged for axial movement in said body through a clamping stroke of a selected distance beyond that of said prescribed initial distance required in said movement of each said clamping rod from a starting clearance position into pressing engagement against one of said wire length ends, and two pressure air cylinders and cooperating piston rods disposed therein operationally connected to actuate each said clamping rod through said clamping stroke for said prescribed distance and whatever portion of said selected distance therebeyond that is necessary for establishing said pressing engagement of each of said clamp against said wire length end, said pressure air cylinders being operationally arranged in pushing contact against the end of said clamping rods remote from said opposite ends thereof having said pressing engagement against said wire length ends and exerting a bias provided by said pressure air effective to cause unimpeded movement of said rods from starting clearance positions thereof to terminating positions as determined by the contact of said rods against said cooperating wire length ends, whereby each said rod moves through said clamping stroke, which is adjustably enlarged, in response to said pressure air until firmly against said wire length end positioned in front of said wire-holding surface despite increases in the distance actually required to be traversed during succeeding clamping strokes.

2. An improved tying machine as defined in claim 1 wherein said separate pressure air cylinder-operated means include separate actuating members disposed in pushing contact with each said clamping rod, said actuating members being pivotally mounted at one end and operatively connected at their opposite ends so as to be urged through a pivotal traverse, whereby during said pivotal traverse of said actuating members said clamping rods are urged through corresponding stroke movement.

3. An improved tying machine as defined in claim 2 wherein one said actuating member is U-shaped with bifurcated legs, and said other actuating member is sized to fit in the clearance between said bifurcated legs.

4. An improved tying machine as defined in claim 3 wherein said air cylinders are disposed on the same side of said actuating members as said clamping rods so as to exert a pulling force on said actuating members incident to causing said pivotal traverses therein which cause said corresponding clamping strokes of said clamping rods.

* * * * *